US011554941B2

(12) United States Patent
Stangl et al.

(10) Patent No.: US 11,554,941 B2
(45) Date of Patent: Jan. 17, 2023

(54) LATTICE PIECE, LATTICE BOOM, AND WORK MACHINE

(71) Applicant: Liebherr-Werk Ehingen GmbH, Ehingen/Donau (DE)

(72) Inventors: Thomas Stangl, Allmendingen (DE); Ulrich Wiedemann, Ulm (DE); Markus Kirschbaum, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 25 days.

(21) Appl. No.: 17/372,350

(22) Filed: Jul. 9, 2021

(65) Prior Publication Data

US 2022/0009751 A1 Jan. 13, 2022

(30) Foreign Application Priority Data

Jul. 10, 2020 (DE) ..... 20 2020 104 000

(51) Int. Cl.
*B66C 23/64* (2006.01)

(52) U.S. Cl.
CPC ..... *B66C 23/64* (2013.01)

(58) Field of Classification Search
CPC ..... B66C 23/64; B66C 23/70
USPC ..... 52/650.1, 650.2, 652.1
See application file for complete search history.

(56) References Cited

U.S. PATENT DOCUMENTS 1,941,952 A * 1/1934 Nickles ..... B66C 23/70 52/638
3,564,789 A * 2/1971 Vyvyan et al. ..... E04C 3/005 52/646
4,253,579 A * 3/1981 Williams ..... E02F 3/48 52/650.2
2001/0045405 A1* 11/2001 Higgins ..... B66C 23/705 212/231
2003/0071005 A1* 4/2003 Higgins ..... B66C 23/708 212/298
2013/0291477 A1* 11/2013 Jobin ..... E04C 3/02 52/655.1
2015/0291401 A1* 10/2015 Orfey ..... B66C 23/70 212/347

(Continued)

FOREIGN PATENT DOCUMENTS

CN 111377367 A 7/2020

OTHER PUBLICATIONS

CN 111377367A Machine Translation (Year: 2020).*

*Primary Examiner* — Michael R Mansen
*Assistant Examiner* — Juan J Campos, Jr.
(74) *Attorney, Agent, or Firm* — McCoy Russell LLP

(57) ABSTRACT

The present disclosure relates to a lattice piece for a lattice boom having four corner bars that are connected to one another by a plurality of posts and diagonals, wherein the lattice piece has a rectangular cross-section having two longer and two shorter sides. A cross-sectional section of the corner bars is designed as a hollow section that has a larger extent in the direction of the longer side of the lattice piece than in the direction of the shorter side of the lattice piece. At least one side of the corner bar section has a stabilization structure in the form of a joint, a kink, a bend, or a rounded portion. The present disclosure further relates to a lattice boom comprising at least one lattice piece in accordance with the present disclosure and to a work machine having such a lattice boom.

20 Claims, 5 Drawing Sheets

(56) References Cited

U.S. PATENT DOCUMENTS

| | | | | |
|---|---|---|---|---|
| 2015/0314995 | A1* | 11/2015 | Schnittker | B66C 23/28<br>212/347 |
| 2016/0016765 | A1* | 1/2016 | Bohnacker | B66C 23/70<br>52/650.1 |
| 2016/0023868 | A1* | 1/2016 | Zimmer | B66C 23/64<br>212/347 |
| 2016/0037764 | A1* | 2/2016 | DePriest | A01M 7/0071<br>248/70 |
| 2017/0057796 | A1* | 3/2017 | Nakashima | B66C 23/64 |

* cited by examiner

LATTICE PIECE, LATTICE BOOM, AND WORK MACHINE

CROSS REFERENCE TO RELATED APPLICATION

The present application claims priority to German Patent Application No. 20 2020 104 000 filed on Jul. 10, 2020. The entire contents of the above-listed application is hereby incorporated by reference for all purposes.

TECHNICAL FIELD

The present disclosure relates to a lattice piece for a lattice boom and to a lattice boom having at least one such lattice piece and to a work machine having such a lattice boom.

BACKGROUND AND SUMMARY

Typical lattice booms for work machines such as cranes or mobile cranes comprise four corner bars that are connected to one another via a plurality of stiffening elements such as diagonals and posts. Lattice booms are here known from the prior art that have a greater width than height. Such a manner of construction produces a smaller deformation and thereby higher payloads due to a higher lateral stiffness and a larger lateral moment of inertia.

It is characteristic of such lattice booms—for instance when their width is selected as large in relation to the height—that the buckling length in the horizontal plate, i.e. at the longer cross-section sides of the lattice boom, is higher than the buckling length in the vertical plate, i.e. at the shorter sides of the lattice boom. The buckling length is here defined as the distance of two connection points between the diagonals and posts at a corner bar. One reason for this is that the buckling length of the stiffening elements running along the long side cannot be shortened as desired since with wide lattice pieces—a suboptimal web bracing that cannot be produced in an economically effective manner arises for angle-geometrical reasons.

A wide lattice boom furthermore requires a certain dismantlability since the crane parts have to be transported via public road traffic, with the maximum permitted transport width being restricted by regulations. To keep the assembly effort and the assembly time of the lattice pieces low, a small number of stiffening elements is therefore likewise aimed for. With fixedly welded diagonals, the welding work in the production of the lattice pieces is additionally increased.

A larger number of diagonals furthermore increases the weight of the lattice pieces, which is disadvantage and is therefore to be avoided both in transport due to corresponding regulations on the maximum transport weight and due to the specifications of the vehicles transporting the crane parts and in crane use with respect to the maximum payload.

A number of diagonal elements that is as small as possible is thus to be aimed for overall, which typically results in different buckling lengths with lattice booms having a smaller height than width.

Lattice pieces are furthermore known from the prior art whose corner bar sections are predominantly circular, i.e. are designed with point symmetry. The moments of inertia and resistance of the corner bars are thus identical in all directions. If now different diagonal distances, i.e. different buckling lengths, are selected with a lattice piece in the horizontal and vertical latticing planes, this results with worse degrees of wear of the corner bar with a round section since the existing support capability potential of the corner bar is not used to the optimum with the shorter buckling length distance.

Rectangular sections can also be used instead of round corner bar sections. In this respect, however, there is the problem of local buckling failure, for instance at the intersection or connection points of the diagonals—due to the large planar, plate-like section parts. One possibility of remedying this problem is the use of stiffening plates that are installed transversely within the corner bar sections to stiffen them locally. This solution is, however, associated with a substantial effort from a technical production aspect since the corner bars have to be assembled from a large number of individual parts in the normal case for this purpose.

Corner bars are furthermore typically equipped with cast or wrought fork-finger connection elements to be able to connect the lattice pieces to other boom elements. Welded fork-finger connection elements are additionally also known. However, they always have a head plate via which the connection to the corner bar is established. There is the disadvantage with this that the sheet metal of the head plate is always strained perpendicular to its rolling direction. There is thereby the risk of lamellar fractures, in a similar manner to wood fibers, that are loaded transversely to the fiber direction (anisotropy)

Against this background, the underlying object of the present disclosure is to optimize a lattice boom having a greater width than height both in a static and in an economic regard.

This object is achieved in accordance with embodiments of the present disclosure.

The lattice piece in accordance with the disclosure accordingly comprises four corner bars that are connected to one another by a plurality of diagonals and posts and has a rectangular cross-section with two longer and two shorter sides. In accordance with the disclosure, the cross-sectional section of the corner bars is designed as a hollow section that has a larger extent in the direction of the longer side of the lattice piece than in the direction of the shorter side of the lattice piece. In other words, the corner bar section has an aspect ratio unequal to one.

The designation "long/longer side" or "short/shorter side" first relates to the cross-sectional section of the lattice piece. In the following, however, for reasons of simplicity, the wider sides of the lattice piece (i.e. the sides with a greater surface measure) are called "long/longer sides" and the narrower sides (i.e. the sides with a smaller surface measure) are called "short/shorter sides".

The corner bar cross-sectional section (also "section" in the following) of the lattice piece in accordance with the disclosure thus differs from the typically used circular or square corner bar sections and is adapted to the cross-sectional shape of the lattice piece. It is thereby possible to adapt the area moment of inertia of the corner bars to the design geometry of the lattice piece and to the demands on optimum statics and thereby to optimally utilize the boom mass used.

On a use of different buckling lengths at the long and short sides of the lattice piece, the area moment of inertia of the corner bars can, for example, be adapted to these different buckling lengths, such as in that the corner bars have a greater extent and thus a larger area moment of inertia in the plane having the greater buckling length than in the plane perpendicular thereto. Round or square corner bar sections have an identical area moment of inertia in both directions, i.e. along the short and long sides of the lattice pieces, and thus ideally utilize the mass present. It is in contrast possible with the corner bar geometry in accordance with the disclosure to optimally bridge different buckling lengths of the lattice piece and thus to increase the economic viability of the lattice piece in accordance with the disclosure.

The hollow section of the corner bar thus can form a closed chamber. The hollow section, including stabilization structures, here can form a single contiguous chamber.

The chamber or the hollow section, for example, cannot be divided substantially along the total length of the corner bar into regions or subchambers separated from one another transversely to the longitudinal corner bar axis (which does not, however preclude that elements can be present within the hollow section such as a stiffening structure in the region of a connection point of the corner bar to a diagonal).

In accordance with the disclosure, at least one side of the corner bar section forming the hollow section has a stabilization structure in the form of a joint or a weld joint, of a kink, of a bend, or of a rounded portion. Additional stiffening elements that increase the total weight of the lattice piece such as stiffening plates that are in particular used with rectangular corner bar sections can thereby be dispensed with.

The at least one stabilization structure designed as a joint, a kink, a bend, or a rounded portion for buckling stabilization is ideally embedded directly into the metal sheet (or one of the metal sheets) forming the corner bar and/or is formed by a transition between two metal sheets and does not thereby increase the total weight. In addition, the production is simplified in comparison with the necessity of attaching additional elements. In other words, the at least one stabilization structure can be a component of the wall (this also includes weld joints connecting a plurality of walls to one another) forming the hollow section of the corner bar, with the wall being able to be assembled, for example, from one or more metal sheets or metal sheet sections.

The at least one stabilization structure can be formed by the shape and/or arrangement of the metal sheet section or sections themselves forming the hollow section of the corner bar. The at least one stabilization structure may not represent an element simply attached to welded to the corner bar from the outside (such as a welded on metal sheet).

If the wall forming the hollow section of the corner bar comprises a plurality of metal sheets, a stabilization structure is in the present case not to be understood as an extension running in the direction of one of the metal sheets transversely to the longitudinal corner bar axis such as a projecting tab for fastening a lattice bar.

Provision is made in an embodiment that the adjacent corner bars that form the shorter sides of the lattice piece are connected to one another via a larger number of diagonals than the adjacent corner bars that form the longer sides of the lattice piece. In other words, the connection points of the diagonals that extend along the longer sides of the lattice piece have a greater distance at the corners bars than the connection points of the diagonals that extend along the shorter sides of the lattice piece so that the corner bars have a greater buckling length in the direction of the longer sides than along the shorter sides of the lattice piece.

The diagonals extending at the longer and/or at the shorter sides can here be releasably connected to the respective corner bars. The diagonals extending at the longer sides can be releasably fastened to the corner bars. This enables a dismantling of the lattice piece in accordance with the disclosure by releasing the corresponding connections to be able to transport the lattice piece separated into a plurality of parts and thereby to be able to observe the legal regulations and the specifications imposed on transport vehicles.

Provision is made in a further embodiment that the corner bars have a greater area moment of inertia in the direction of the longer sides of the lattice piece than in the direction of the shorter sides of the lattice piece. A different number of diagonals at the long/short sides of the lattice piece or different buckling lengths can thereby be ideally compensated.

Provision is made in a further embodiment that the corner bars have a cross-sectional section differing from a rectangular shape. Rectangular corner bar sections are unfavorable from a static aspect since in addition to normal forces, bending moments also act at the junctions or connection points of the diagonals and posts set onto the corner bars, which can result in local buckling problems in the region of the connection points with a plate-like connection to the corner bar. These bending moments pull the corner bar metal sheet out of the corner bar at one side and press the corner bar in on the oppositely disposed side. Without additional stiffening or other measures effecting a stiffening in this region, the corner bar can therefore buckle since the metal sheets of the rectangular plate are "self-supporting" and are not underpinned.

The corner bar section of the lattice piece in accordance with the disclosure can have the form of an ellipse, of an irregular and a convex polygon, or even of a regular polygon, but in the latter case only if the width of the regular polygon has a different width along one of the two sides of the lattice piece than along the side extending perpendicular thereto. The corner bar section can also represent a combination of different shapes, for example in that one side is ellipsoid and the other side is angular. The corner bar section can have a combination of kinks/edges and rounded sections/bends/curves. A kink can here also be a weld seam of two connected metal sheets.

Provision is made in a further embodiment that the stabilization structure extends substantially along the total length of the corner bar.

The stabilization structure can form a change of direction of the outer contour of the hollow corner bar section transversely to the longitudinal axis of the corner bar, and indeed as previously described in the form of a (weld) joint, of a kink, of a bend, or of a rounded portion, with these terms being able to blur into one another.

Provision is made in a further embodiment that the corner bar section has a total of at least five kinks, bends, and/or rounded portions.

Provision is made in a further embodiment that the corner bars are produced in one piece from a metal sheet, that is form a single-part hollow section. It could, for example, be produced in a similar manner to an n-sided pipe (e.g. n=5) and can be provided with corresponding kinks/rounded portions.

Provision is made in an alternative embodiment that the corner bars are produced from at least two metal sheets welded to one another. The section of the corner bar in accordance with the disclosure is ideally joined together from two metal sheet sections and is welded by means of two longitudinal seams extending along the corner bar.

In this respect, the two metal sheets can have the same shape and can be welded to one another such that the corner bar section has point or axis symmetry.

The two metal sheets can alternatively each have different shapes. A cross-section geometry optimized with respect to the mass of the corner bar can thereby result that nevertheless satisfies the above demands with respect to different area moments of inertia/extents along different sides of the lattice piece. The metal sheets can be welded to one another such that the corner bar section is axially symmetrical.

Provision is made in a further embodiment that at least one stiffening element is attached within the corner bar section in the region of a connector point of a diagonal to the corner bar. The stiffening element serves the additional stabilization or stiffening of the corner bar in the region of the neuralgic connection point of the diagonal corner bar and acts in addition to an optionally provided stabilization structure against a buckling of the corner bar metal sheet. This enables a production of the corner bar such as thin metal sheets.

Provision is made in an embodiment that the stiffening element extends in the longitudinal direction of the corner bar and may only be attached inwardly in the corner bar at the side at which the diagonal is connected to the corner bar. The size and the weight of the stiffening element can thereby be reduced and the desired stabilization effect can nevertheless be achieved. A simple production of the corner bar results due to the longitudinal direction of the at least one stiffening element (unlike with a stiffening plate installed transversely to the longitudinal direction of the corner bar) since the stiffening element can be simply installed before the joining together of the individual corner bar shells or corner bar metal sheets.

The stiffening element can be a rib or a similar stiffening element that supports optionally provided stabilization structures such as kinks/bends, etc. in buckling stabilization. Such a stiffening element can be provided at every connection point of a diagonal to a corner bar. The stiffening element can be formed as shell-shaped or semi-shell shaped, with the concave side of the connection point facing the diagonal.

Provision is made in a further embodiment that each corner bar has a respective mount at the two ends to/in which a connection element, such as a fork element, is attached/inserted and welded for connection to a complementary connection element, for instance a counter-fork element, of a different lattice piece. The connection element can thereby be installed with minimal weld distortion. In addition, a head plate can be dispensed with, and thus the above-addressed risk of lamellar fractures can be avoided. The load on the longitudinal seam connecting the connection element to the corner bar takes place on shear. The connection element can be attached/inserted at/in the mount of the corner bar a prefabricated form and can optionally be subsequently subjected to mechanical working. In combination with the optimized corner bar section, the performance of the lattice piece in accordance with the disclosure can be increased by means of such an improved fork/fork design. The connection elements can be attached to the mounts.

The fork elements can have a layer structure of a plurality of metal sheets welded to one another and of different shapes. The components welded in advance in a sandwich design can be attached/inserted to/in the provided mounts. In addition, connection points for stiffening element connections to the corner bar that may be likewise releasable and lateral can be provided at the connection elements. One side of the fork element can be suitably designed for this purpose. Only the other side has a chamfer applied for weight reasons.

The diagonals of the lattice piece can have a diameter that is smaller than the distance of two stabilization structures at the corresponding side surface of the corner bar. This enables a simpler production of the lattice piece.

Alternatively, the diagonals can have a diameter that is greater than the distance of two stabilization structures at the corresponding side surface of the corner bar. A statically more advantageous design thereby results.

An embodiment of the lattice piece is also conceivable in which the one or more diagonals have a smaller diameter and one or diagonals have a larger diameter than the distances of the stabilization structures at the corresponding side surfaces of the corner bars to which the diagonals are connected.

The present disclosure further relates to a lattice boom having at least one lattice piece in accordance with the disclosure and to a work machine, such as a crane, or a crawler crane or a mobile crane, having such a lattice boom. The same advantages and properties thereby obviously result as for the lattice piece in accordance with the disclosure so that repeat statements will be dispensed with at this point.

BRIEF DESCRIPTION OF THE FIGURES

Further features, details, and advantages of the disclosure result from the embodiments explained in the following with reference to the Figures. There are shown.

DETAILED DESCRIPTION

Figure 1:
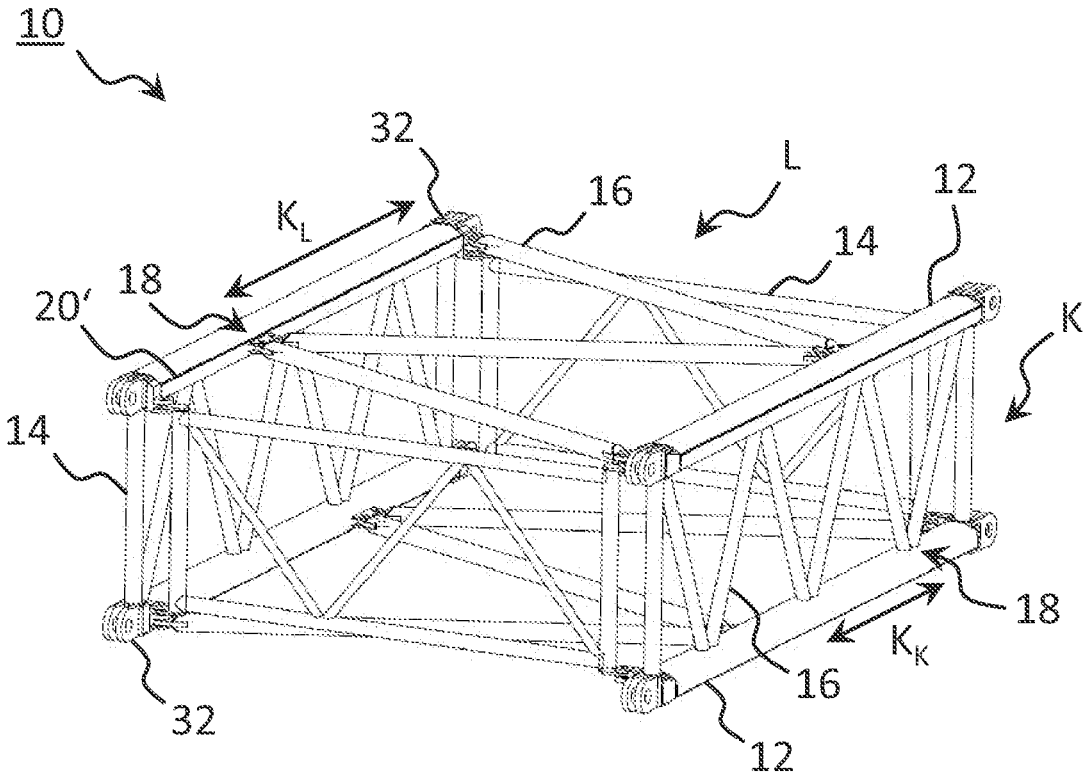
FIG. 1: an embodiment of the lattice piece in accordance with the disclosure in a perspective view.

An embodiment of the lattice piece 10 in accordance with the disclosure is shown in a perspective view in FIG. 1. The lattice piece 10 comprises four parallel corner bars 12 that have connection elements 32 that are formed as fork elements at the ends and via which the lattice piece 10 is connectable to other lattice pieces 10 or boom parts to form a boom, such as a lattice boom, of a mobile crane or crawler crane. Two respective adjacent corner bars 12 are connected to one another via a plurality of posts 14 and diagonals 16.

The lattice piece 10 has a rectangular cross-section with a greater width than height. In this respect, the corner bars 12 are connected to one another along the long sides L of the lattice piece 10 via a smaller number of diagonals 16 than along the shorter side K of the lattice piece 10. In FIG. 1, the corresponding buckling lengths $K_K$ and $K_L$ are drawn that result from the respective distances of the connection points 18 of the diagonal elements 16 at the corner bars 12. As can be recognized, the corner bars 12 have different buckling lengths $K_L$, $K_K$ for the diagonals 16 of the long and short sides L, K, with the buckling length $K_L$ being larger than the buckling length $K_K$.

Figure 2:
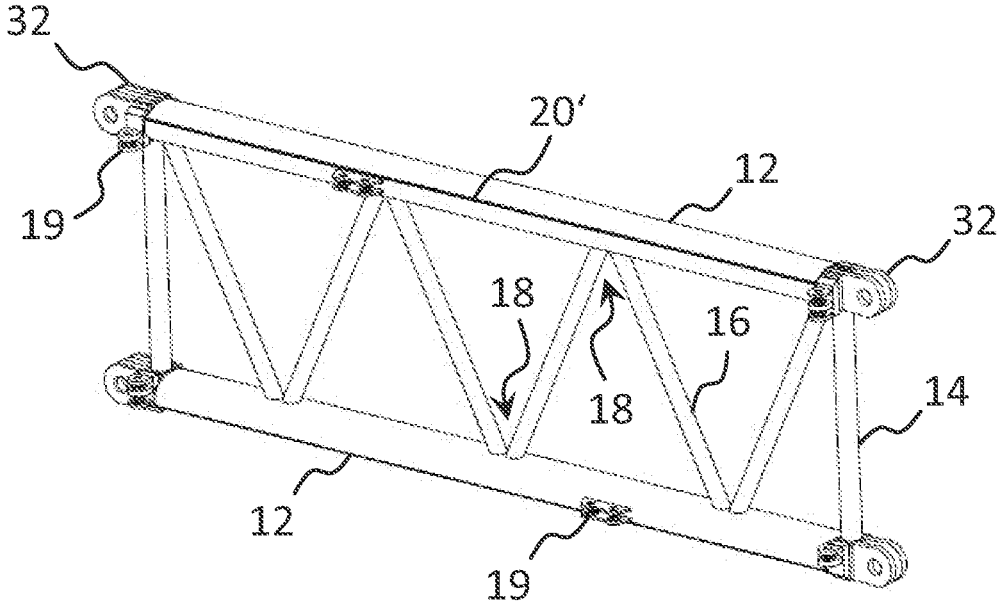
FIG. 2: a side element of the lattice piece of FIG. 1 in a perspective view.

The diagonals 16 extending at the long sides L of the lattice piece 10 are releasably connected to the corner bars 12, while the diagonals 16 of the short sides K are fixedly welded to the corner bars 12. FIG. 2 shows a single side part that forms one of the short sides K of the lattice piece 10, with fastening elements 19 or pin points for the diagonals 16 attached to the corner bars 12 and to the fork elements 32 and the side parts forming the front faces of the lattice piece 10 being able to be recognized.

The lattice piece 10 has a higher lateral stiffness and a higher torsion stiffness due to the greater width, which results in a smaller deformation and a higher payload in crane operation. The divisibility of the lattice piece 10 in the vertical plane facilitates the transport of the lattice piece 10. The diagonals 16 and corner bars 12 are here optimally adapted to the geometry of the lattice piece 10. The smaller number of diagonals 16 at the long sides L cause a smaller installation effort, a smaller total weight, and fewer tolerances.

Figure 3:
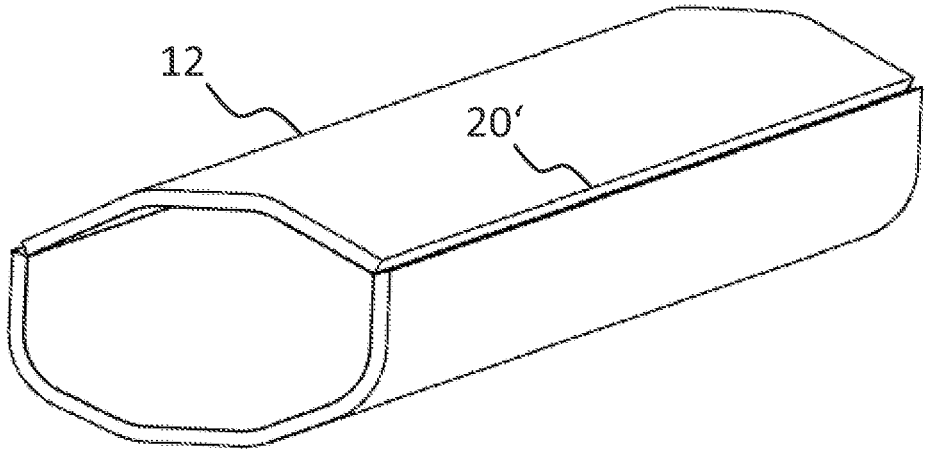
FIG. 3: a perspective cross-sectional view of the corner bar of the lattice piece in accordance with the disclosure in accordance with an embodiment.
Figure 4:
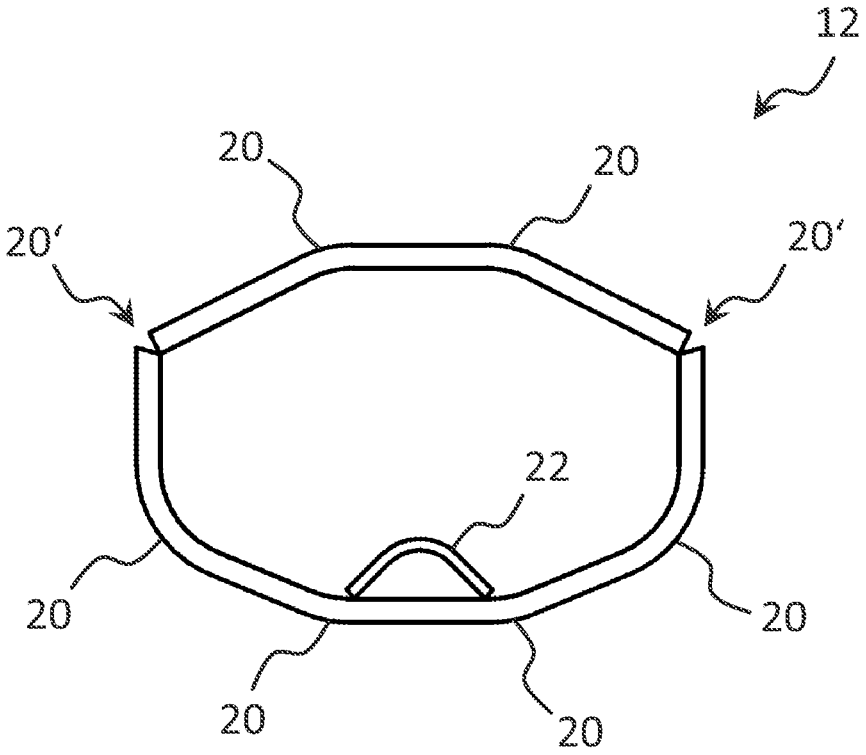
FIG. 4: the corner bar section of FIG. 3 in a schematic frontal view.

The larger buckling length $K_L$ at the long side L associated therewith is now compensated in accordance with the disclosure by an optimized section of the corner bars 12. FIGS. 3 and 4 show an embodiment of the corner bar 12 with an optimized cross-sectional section in a perspective view and in a schematic frontal view. The corner bar section in accordance with the disclosure differs from the typically used circular or square cross-sectional shapes in that it has a greater width than height, that is an aspect ratio not equal to one. The corner bar 12 has the greater extent in this respect in the direction of the long side L of the lattice piece 10 to compensate the greater buckling length $K_L$ in this plane by the higher area moment of inertia that results therefrom. The mass of the lattice piece 10 is optimally utilized in this process.

The corner bar 12 is assembled from two differently shaped metal sheet sections that are welded to one another by longitudinal seams 20' (weld joints) and that form a hollow section. The metal sheets are each formed with axial symmetry and are joined together such that the resulting corner bar section also has axial symmetry (cf. FIG. 4, the vertical axis of symmetry divides the section at the center). The metal sheet sections of the corner bar 12 each have rounded portions or bends 20 (that can also be understood as "kinks") that serve buckling stabilization and extend along the total length of the corner bar 12. The use of additional components such as welded transverse stiffening plates can be dispensed with due to these stabilization structures 20 that are easy to produce and that are implemented in the shaping of the section metal sheets themselves (i.e. the stabilization structures are formed by the shape and/or arrangement of the section metal sheets themselves that form the hollow section. The weld seams 20' can also be understood as stabilization structures. The corner bar section substantially has the shape of a convex irregular polygon overall. In FIG. 4, a stiffening element 22 arranged within the hollow section can furthermore be recognized that will be described further below.

Figure 5A:
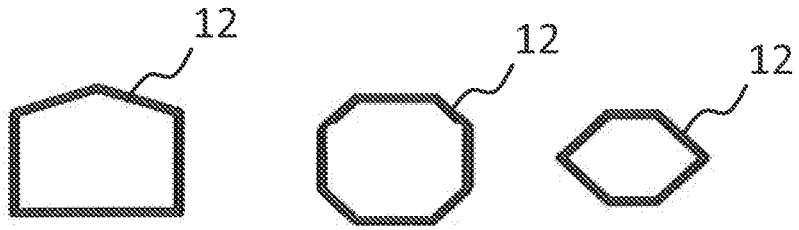
FIGS. 5*a-b*: a plurality of embodiments for cross-sectional sections of the corner bar of the lattice boom in accordance with the disclosure in a schematic frontal view in each case.
Figure 5B:
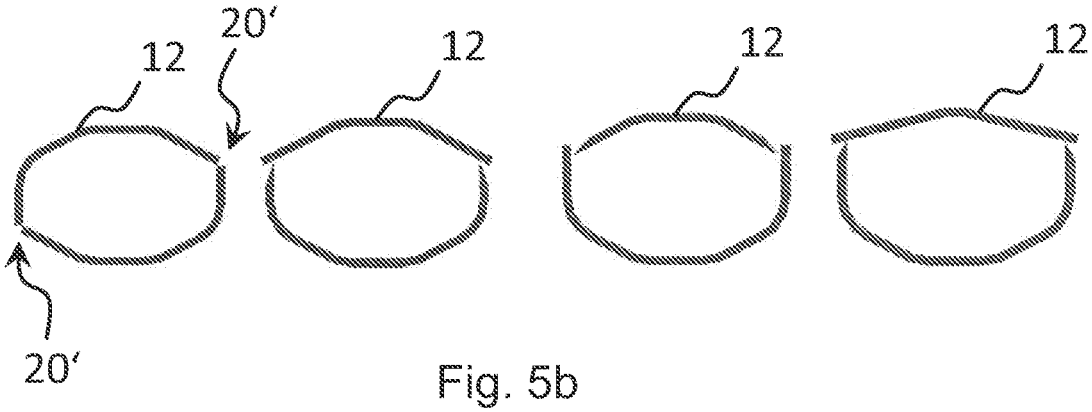

The embodiment shown in FIGS. 3 and 4 is, however, only one of many configuration possibilities of the corner bar section to implement a desired buckling stabilization and buckling length adaptation. Further examples are shown in FIGS. 5*a* and 5*b* in a frontal view in each case. In this respect, FIG. 5*a* shows examples having axial symmetry for sections produced in one piece (these shapes can naturally also be composed of two or more metal section sheets). The sections shown in FIG. 5*b* are substantially oval or ellipsoid, with the sections having a plurality of bends/rounded portions/kinds viewed close up. Except for the example at the far left, the sections of FIG. 5*b* are composed of two differently shaped metal sheets and likewise have axial symmetry. The section shown at the far left in FIG. 5*b* is, in contrast, assembled from two identically shaped metal sheets and has point symmetry overall, which inter alia simplifies the manufacture.

Figure 6:
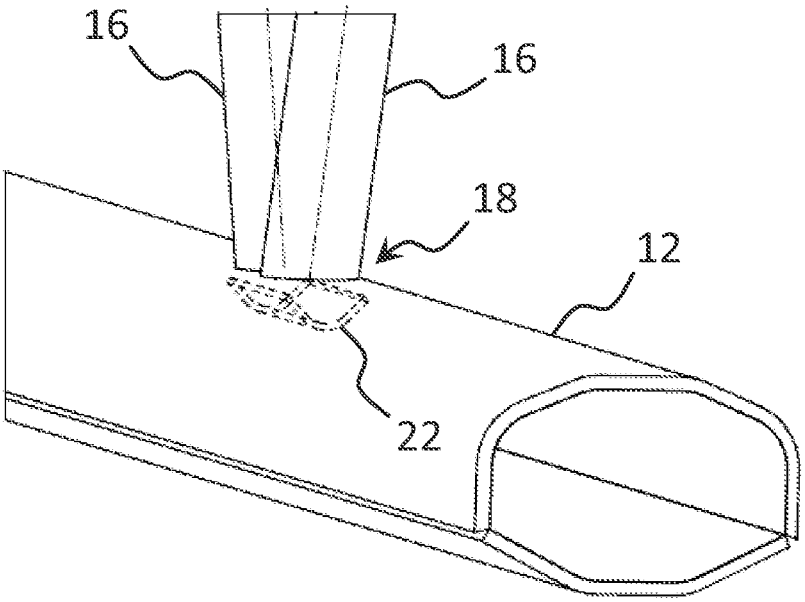
FIG. 6: an enlarged view of a stiffening element at the connection point of two diagonals at a corner bar in accordance with an embodiment.

To stabilize the corner bars 12 even more against buckling, such as on the use of thin section metal sheets, additional stiffening elements 22 can be installed within the hollow section of the corner bars 12. An example for this is shown in FIG. 6 in which a detail of a connection point 18 of two diagonals 16 at the corner bar 12 is shown. In this respect, the stiffening element 22 that is arranged inwardly in the corner bar 12, that extends along the longitudinal direction of the corner bar 12, and that is fastened or welded to the inner side of the hollow section at the side facing the connection point 18 is shown dashed since it cannot be seen from the outside. The connection element 22 in this embodiment is bent along its middle axis in parallel with the longitudinal axis of the corner bar 12. FIG. 4 shows the stiffening element 22 in a frontal view.

Such an angular or half-shell shaped stiffening element 22 may be present per connection point 18 to stabilize the junctions 18. However, a variety of other designs are also conceivable here. Such stiffening elements 22 can be effected easily in the case of a corner bar 12 composed of two metal sheet sections since these longitudinal elements 22 can already be installed before the joining together or welding of the corner bar metal sheets.

The performance of the lattice piece 10 in accordance with the disclosure is expanded by an optimized fork/fork design. For this purpose, the corner bars 12 have connection elements 22 at the two ends that are designed as fork elements each having a bore for establishing a releasable pin connection between two lattice pieces 10 or between one lattice piece 10 and another boom part such as an articulated connection piece, boom head, or the like.

Figure 7A:
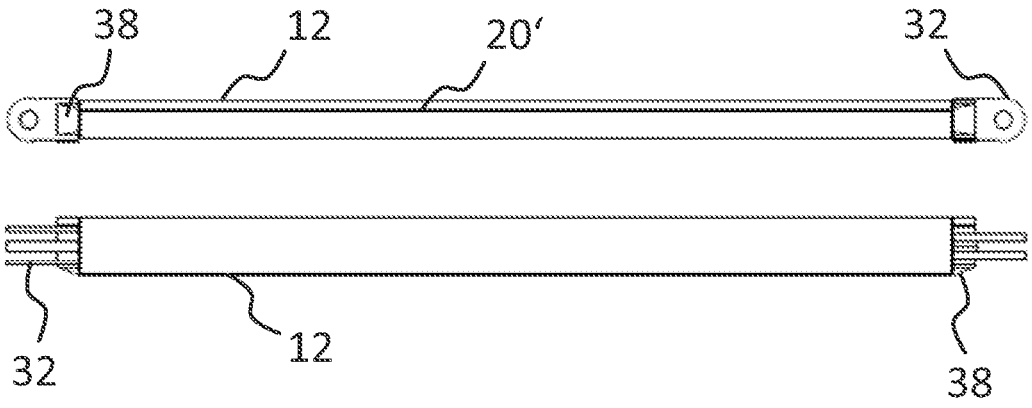
FIG. 7*a*: a corner bar having fork elements in accordance with an embodiment in a side view and in a top view.
Figure 8A:
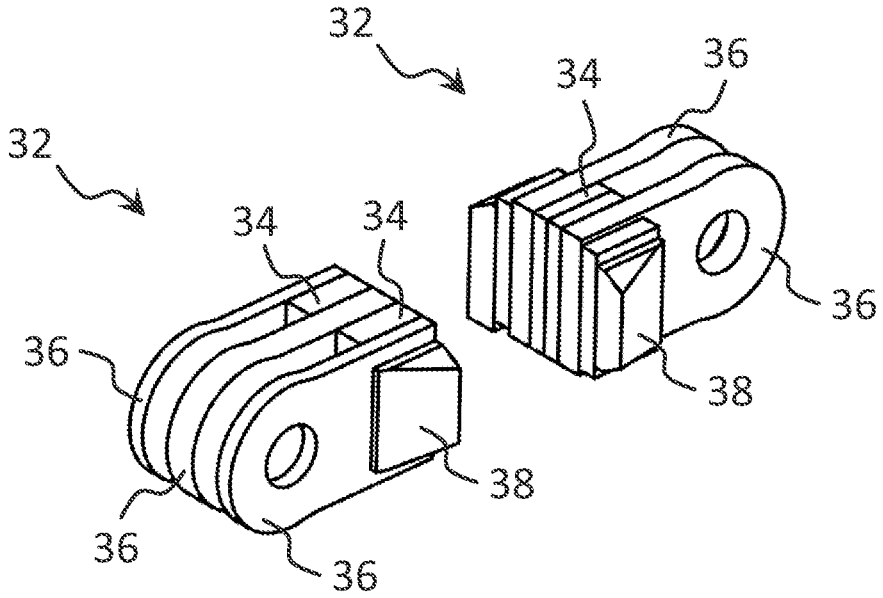
FIG. 8*a*: a fork element and a counter-fork element of the corner bar of FIG. 7*a* in perspective single views.

A corner bar 12 having the two fork elements 32 attached to both sides in accordance with a first embodiment is shown in FIG. 7*a* in a side view (upper illustration) and a plan view (lower illustration). FIG. 8*a* shows the individual fork elements 32 in a perspective view. The fork elements 32 are set at the ends or mounts of the corner bar 12 in this embodiment. The fork elements 32 have chamfers 38 at one side and are suitably designed on the oppositely disposed side to be able to affix the fastening elements 19 (cf. FIG. 2).

Figure 7B:
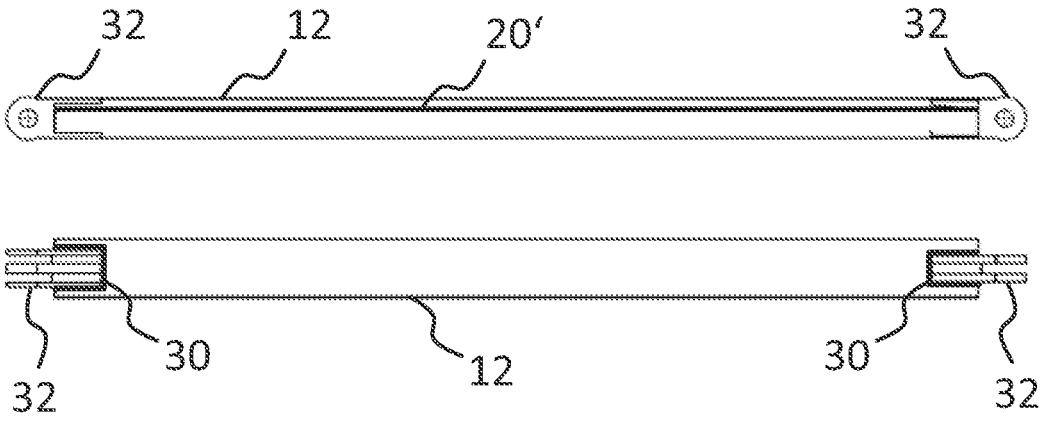
FIG. 7*b*: a corner bar having fork elements in accordance with a further embodiment in a side view and in a top view.
Figure 8B:
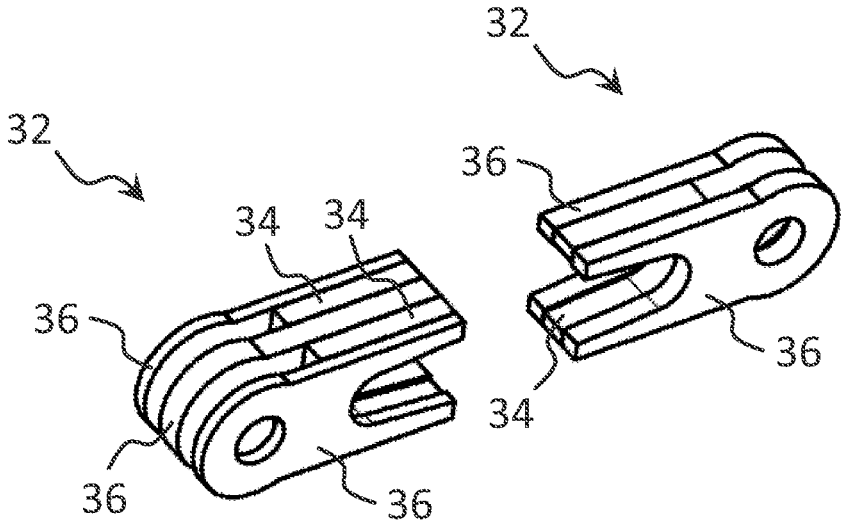
FIG. 8*b*: a fork element and a counter-fork element of the corner bar of FIG. 7*b* in perspective single views.

FIGS. 7*b* and 8*b* show a second embodiment in which the fork elements 32 are inserted into corresponding mounts or cutouts at the ends of the corner bar 12 and are welded thereto. This manner of construction enables a welding with minimal weld deformation and an omission of head plates at the ends of the corner bars 12 that are prone to breakage. The weld seams 30 between the fork element 32 and the corner bar 12 are shown as thick black lines in FIG. 7*b* and are loaded on shear in operation.

The fork and counter-fork element 32 have different designs in the two embodiments to enable a joining into one another and have a layer design or a sandwich structure comprising a plurality of welded lamellae 34, 36. The lamellae 34, 36 have different shapes or contours. Alternatively to the lamella design, thin metal connection sheets can e.g. also be used as spacers between the fingers of the fork elements 32. These prefabricated fork elements 32 can be subjected to a mechanical post-machining as a whole. Releasable connection points for post connections to the corner bars 12 can additionally be provided at the fork/fork packets.

The ("edged") shape of the corner bars 12 in accordance with the disclosure provided with stabilization structures 20, 20' provides some further advantages or properties in addition to those described above.

1) Embodiment of the diagonal connection advantageous from a technical production aspect: Diameter of the diagonals 16 becomes smaller than the distance selected between two stabilization structures 20, 20' at the corresponding side surface of the corner bar section 12.
2) Statically advantageous embodiment of the diagonal connection: Diameter of the diagonals 16 becomes larger than the distance selected between two stabilization structures 20, 20' at the corresponding side surface of the corner bar section 12.
3) Advantageous arrangement of the weld joints 20' within the corner bar section 12: Arrangement of the weld joints 20' such that all the weld joints 20' are located on one side of the corner bar section 12 (cf. FIG. 5*b*, third section from the left) so that the corner bar section 12 does not have to be rotated during welding. This means that the corner bar 12 can be assembled, for example, from two half-shell metal sheets, with one of the half shells having a somewhat larger width than the second half shell. Both weld seams can be produced from one side, optionally only rotated by a few degrees (and indeed also in a "down-hand position").
4) Advantageous embodiment of the bends/edges 20 of the corner bar 12 with an inner radius that is as small as possible (e.g. 4× the sheet metal thickness). An even smaller radius can only be produced with difficulty from a technical production aspect. It must be noted that this radius also defines the minimal distance from adjacent bends/edges 20. The number of bends/edges 20 that can be technically produced in a corner bar 12 is thus also restricted.

REFERENCE NUMERAL LIST

10 lattice piece
12 corner bar
14 post
16 diagonal
18 connection point
18 fastening element
20 stabilization structure (kink/bend/rounded portion)
20' weld seam
22 stiffening element
30 weld seam
32 connection element (fork element)
34 metal sheet/lamella
35 metal sheet/lamella
38 chamfer
$K_K$ buckling length, short side
$K_L$ buckling length, long side
K short side of the lattice piece
L long side of the lattice piece

The invention claimed is:

1. A lattice piece for a lattice boom having four corner bars that are connected to one another by a plurality of posts and diagonals, wherein the lattice piece has a rectangular cross-section having two longer sides and two shorter sides, wherein a cross-sectional section of the four corner bars is a hollow section that has a larger extent in a direction of the two longer sides of the lattice piece than in a direction of the two shorter sides of the lattice piece, with at least one side of the corner bar section having a stabilization structure in the form of a joint, a kink, a bend, or a rounded portion.

2. The lattice piece in accordance with claim 1, wherein adjacent corner bars that form the two shorter sides of the lattice piece are connected to one another over a larger number of diagonals than adjacent corner bars that form the two longer sides of the lattice piece, with the diagonals extending at the longer and/or at the shorter sides.

3. The lattice piece in accordance with claim 2, wherein the lattice piece with the diagonals extending at the longer and/or at the shorter sides can be releasably fastened to the respective corner bars.

4. The lattice piece in accordance with claim 1, wherein the four corner bars have a greater area moment of inertia in the direction of the two longer sides of the lattice piece than in the direction of the two shorter sides of the lattice piece.

5. The lattice piece in accordance with claim 1, wherein the four corner bars have a cross-section differing from a rectangular shape.

6. The lattice piece in accordance with claim 1, wherein the stabilization structure extends substantially along a total length of the corner bar.

7. The lattice piece in accordance with claim 6, wherein the stabilization structure forms a change in direction of the outer contour of the hollow section transversely to the longitudinal axis of the corner bar.

8. The lattice piece in accordance with claim 1, wherein the corner bar section has at least five kinks, bends, and/or rounded portions in total.

9. The lattice piece in accordance with claim 1, wherein the four corner bars are produced in one piece from a metal sheet.

10. The lattice piece in accordance with claim 1, wherein the four corner bars are produced from at least two metal sheets welded to one another.

11. The lattice piece in accordance with claim 10, wherein the at least two metal sheets have the same shape.

12. The lattice piece in accordance with claim 11, wherein the at least two metal sheets are welded to one another such that the corner bar section has point or axis symmetry.

13. The lattice piece in accordance with claim 10, wherein the at least two metal sheets have different shapes.

14. The lattice piece in accordance with claim 13, wherein the at least two metal sheets are welded to one another such that the corner bar section has axis symmetry.

15. The lattice piece in accordance with claim 1, wherein at least one stiffening element is attached within the corner bar section in a region of a connection point of a diagonal.

16. The lattice piece in accordance with claim 15, wherein the stiffening element extends in a longitudinal direction of the corner bar and is only attached inwardly in the corner bar at the side at which the diagonal is connected to the corner bar.

17. The lattice piece in accordance with claim 1, wherein each corner bar has a respective mount at two ends to or in which a connection element is attached or inserted and welded for connection to a complementary connection element of a different lattice piece.

18. The lattice piece in accordance with claim 17, wherein the connection element is a fork element and the complementary connection element is a counter-fork element, the fork elements having a layer design of a plurality of differently shaped metal sheets welded to one another.

19. A lattice boom having at least one lattice piece in accordance with claim 1.

20. A work machine having the lattice boom in accordance with claim 19.

* * * * *